US005400696A

United States Patent [19]

Weber

[11] Patent Number: 5,400,696

[45] Date of Patent: Mar. 28, 1995

[54] FLUID-OPERATED DRIVE

[75] Inventor: Bruno Weber, Berg, Switzerland

[73] Assignee: Feramatic AG, Bürglen, Switzerland

[21] Appl. No.: 212,390

[22] Filed: Jan. 28, 1994

[30] Foreign Application Priority Data

Feb. 3, 1993 [CH] Switzerland ..... 00322/93

[51] Int. Cl.[6] ..... F01B 9/00

[52] U.S. Cl. ..... 92/137; 92/177

[58] Field of Search ..... 92/137, 165 PR, 177

[56] References Cited

U.S. PATENT DOCUMENTS

| | | | |
|---|---|---|---|
| H166 | 11/1986 | Byrd | 92/165 PR |
| 3,965,802 | 6/1976 | Jacobs | 92/137 |
| 4,080,877 | 3/1978 | deFries | 92/177 |
| 4,467,705 | 8/1984 | Reist | 92/137 |
| 4,896,584 | 1/1990 | Stoll et al. | 92/177 |

FOREIGN PATENT DOCUMENTS

| | | |
|---|---|---|
| 3732741 | 4/1989 | Germany . |
| 4028159 | 3/1992 | Germany . |
| 2140087 | 11/1984 | United Kingdom . |

*Primary Examiner*—F. Daniel Lopez
*Attorney, Agent, or Firm*—Walter C. Farley

[57] ABSTRACT

The invention relates to a drive, particularly a push and pull drive, which has a cylinder with a cylinder inner chamber (Z) and a cylinder axis (F) and a piston movably arranged in the cylinder and to which is fixed a flexible force transfer means (U). For a double-action drive the cylinder inner chamber (Z) or the piston must have a larger cross-sectional surface than the force transfer means (U). In order that, despite this, the cylinder wall can serve as a guidance means for the flexible force transfer means, either the cylinder inner chamber or the force transfer means has a non-circular cross-section, so that on a cross-section there are at least two points (A1 to A3), on which the cylinder inner wall can guide the force transfer means.

10 Claims, 3 Drawing Sheets

FLUID-OPERATED DRIVE

Figure 1A:
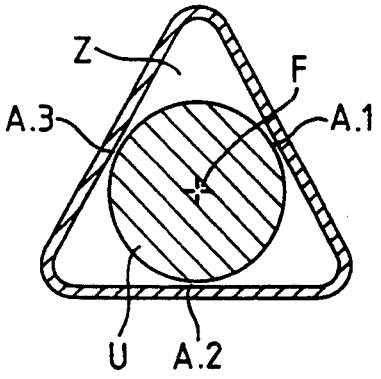
Figure 1B:
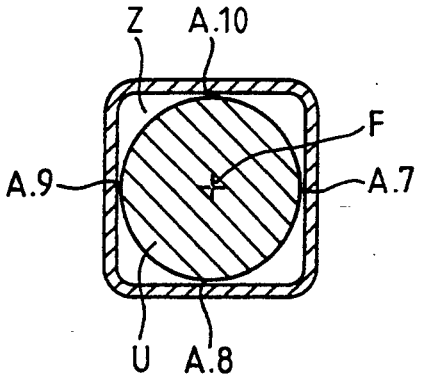

The invention relates to a fluid-operated drive according to the preamble of independent claim 1 and in particular a double-acting push and/or pull drive with a piston movable in a cylinder and a flexible force transfer means fixed to the piston, with which the force produced by the drive outside the cylinder can be transferred in a substantially random direction.

European patent 57818 of the same applicant discloses a fluid-operated drive, which has a cylinder, a piston movable in the cylinder and flexible force transfer or transmission means fixed to the said piston and e.g. in the form of a spherical joint link chain. In order that the piston can function in double-acting manner, i.e. so that pressure can be supplied to both sides thereof, its cross-sectional surface, which is substantially the same as the cross-sectional surface of the cylinder inner chamber, is larger than the cross-sectional surface of the force transfer means. As the force transfer means is flexible, if it is to be pressurized, it must be guided in the interior of the cylinder. As a result of the requirements made on the cross-sectional surfaces, it cannot be guided by the cylinder wall in the same way as the piston. Thus, within the cylinder and parallel to its axis there are guide rods for guiding the force transfer means, said guide rods penetrating the piston.

It has been found that the force transfer means, which are naturally not guided free from play by the guide rods and in particular in the case of the transfer of high thrust forces and in spite of the guidance, are subject to buckling and consequently forces are exerted on the guide rods, which are directed transversely to the movement direction of the piston and the force transfer means. The higher the pressure exerted on the force transfer means and the greater the buckling which takes place in spite of the guidance of the force transfer means, the higher the transverse forces acting on the guide rods. To ensure that the guide also functions in a completely satisfactory manner with very high pressure loads and in particular with high strokes, the guide rods must be designed for very high loads, i.e. the cross-section thereof must be increased. This size increase with respect to the piston cross-sectional surface leads to an enlargement of the piston, if in the case of identical fluid pressures identically high forces are to be transferred. Thus, the size of the drive and its weight must be increased for applications involving high forces.

The drive described in the aforementioned European patent has a cylinder with a circular cross-section, in which there are e.g. four circular cylindrical guide rods at an angle of 90° to one another and a guide circle coaxial to the cylinder. The individual links of the spherical joint link chain have point contact with the rods. The maximum possible buckling of the chain is directed centrally between two rods, the deflection of the chain from the axis of the cylinder being $\sqrt{2}$ times the central spacing of the guide rods caused by the play. It has been found that in said drive said guide rods determine the upper limit of the thrust forces which can be transferred by the drive.

The problem of the present invention is to so improve the aforementioned drive, that substantially without increasing the overall size and the weight, it can be used for the transfer of higher forces, particularly higher thrust forces.

This problem is solved by the drive according to the independent claim 1.

The main feature of the drive according to the invention is that the flexible force transfer means in the cylinder inner chamber is guided at at least two points of its cross-section by the cylinder wall. The cylinder wall must be designed for the fluid pressures used and must therefore have a mechanical strength which can readily absorb the forces occurring through the buckling of the force transfer means transversely to the movement direction of the piston and the force transfer means. The cylinder inner wall for the guidance of the piston is equipped with a corresponding surface, which can also be used for guiding the force transfer means, if the material of the latter is adapted to the cylinder material. The force transfer means is guided on the cylinder inner wall by point, line or surface contact between said inner wall and the force transfer means. It is also possible to additionally guide the force transfer means by guide elements arranged in the cylinder inner chamber parallel to the cylinder axis and which penetrate the piston.

The force transfer or transmission means, which is to have a smaller cross-sectional surface than the piston, which has the same cross-sectional surface as the cylinder inner chamber, can be guided on the cylinder inner wall, if either the cross-sectional surface of the piston or that of the force transfer means is not circular. It is also possible for both cross-sectional surfaces not to be circular, but this leads to more complicated constructions. A guidance on the cylinder wall (at only one point of a cross-section) is also possible in the case of two circular cross-sectional surfaces, if the axis of the force transfer means does not coincide with the axis of the cylinder, said constructions leading to asymmetrical ratios of forces on the piston, with respect to which preference is given to symmetrical constructions relative to the cylinder axis.

Exemplified embodiments of the drive according to the invention are described in greater detail hereinafter relative to the drawings, wherein show:

FIGS. 1*a* to 1*f* Cross-sections of exemplified embodiments of the inventive drive with the cylinder/piston system and a non-circular cross-sectional surface and a force transfer means with a circular cross-sectional surface.

Figure 2A:
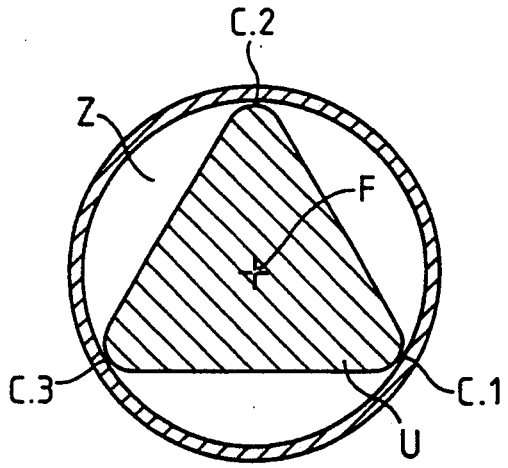
Figure 2C:
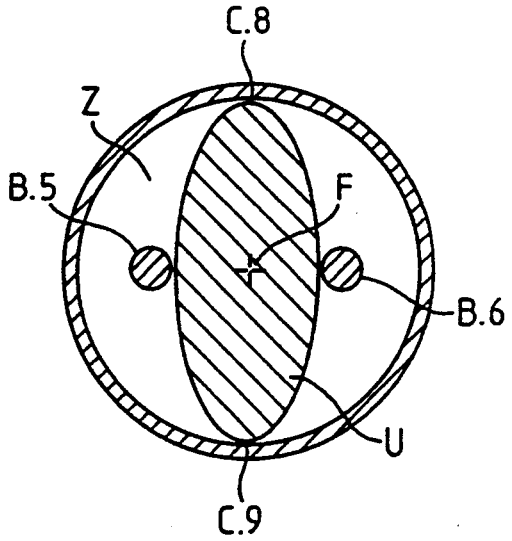
Figure 2B:
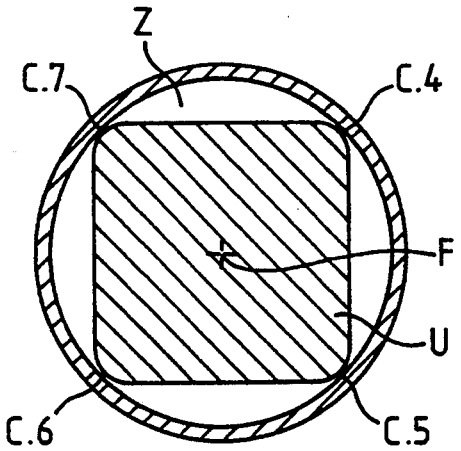

FIGS. 2*a* to 2*c* Cross-sections of exemplified embodiments of the inventive drive with the cylinder/piston system with circular cross-sectional surface and a force transfer means with non-circular cross-sectional surface.

Figure 3:
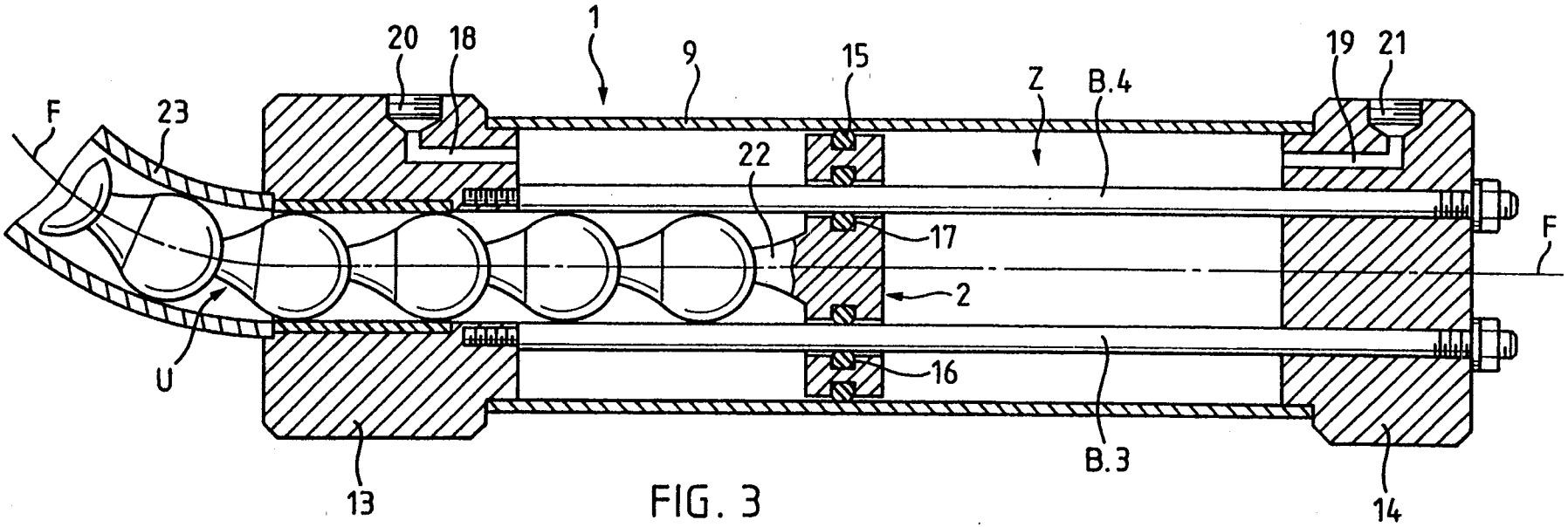

FIG. 3 A section (section line III—III in FIG. 1*e*) parallel to the cylinder axis through an exemplified embodiment of the inventive drive with additional guide elements in the cylinder inner chamber.

FIGS. 1*a* to If show diagrammatic cross-sections through different exemplified embodiments of the drive according to the invention. All the drawings show a cylinder with a cylinder axis F and a cylinder inner chamber Z, whose cross-sectional surface corresponds to that of a not shown piston movably arranged in the cylinder, as well as a force transfer means U. All the embodiments have a circular cross-sectional surface of the force transfer means and a non-circular cross-sectional surface of the cylinder inner chamber Z, the cross-sectional surface of the cylinder inner chamber Z being larger than the cross-sectional surface of the force transfer means U and the cylinder wall is designed in such a way that its surface directed against the cylinder inner chamber Z can be used at at least two points of a cross-section as a guide means for the force transfer means U. In all represented embodiments the cylinder axis F coincides with the axis of the force transfer means, which is not a necessary condition, but is advantageous due to the resulting, symmetrical force ratios.

The force transfer means U is flexible, so that it is guided outside the cylinder in a corresponding guide, e.g. in a flexible tube and can transfer the force in a substantially random direction. It is e.g. a spherical joint link chain, such as is described in German patents 2220259 or 3121835 of the same applicant. The cross-sectional surface of the spherical joint link chain shown in the drawings is then the largest cross-sectional surface of the chain, but naturally other flexible force transfer means are possible. It is e.g. possible to use a flexible tube, which for stiffening purposes is filled with a gaseous or liquid medium which is under pressure. It is also possible to use a flexible bar, e.g. made from plastic, a cable or a wire rope.

Figure 1C:
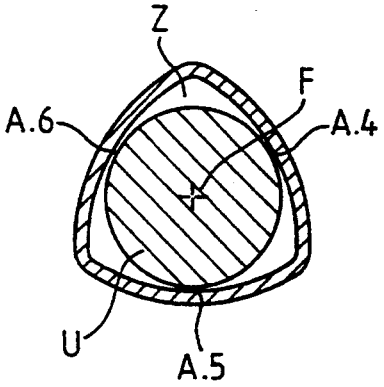

In FIGS. 1*a* and 1*c* the cylinder inner chamber Z has a triple symmetry axis with respect to the cylinder axis F (i.e. has a substantially triangular cross-sectional surface) and in each case three guide points A1 to A3 or A4 to A6, which are so distributed around the cylinder inner chamber circumference that the force transfer means U is guided in a satisfactory manner. In the same way the embodiment of FIG. 1*b* has a quadruple symmetry axis and four guide points A7 to A10 through which the force transfer means U is also guided in a satisfactory manner. For these and similar embodiments, in which the cross-sectional surface of the cylinder inner chamber is essentially in the form of a regular polygon, the ratio of the cross-sectional surfaces of the piston and force transfer means is limited.

Figure 1D:
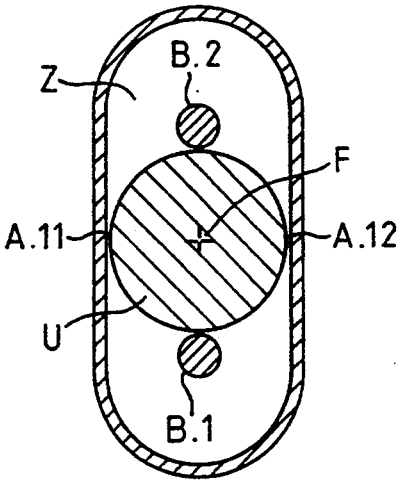
Figure 1E:
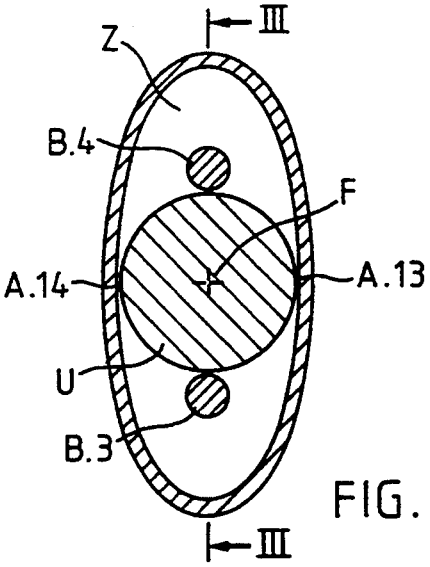
Figure 1F:
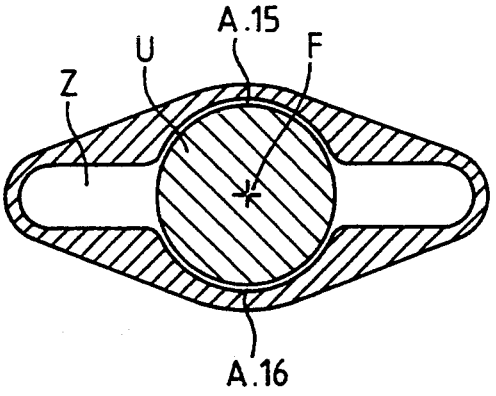

On the cylinder inner wall, the two embodiments according to FIGS. 1*d* and 1*e* in each case have only two facing guide points A11 and A12 or A13 and A14. Such a guidance of the force transfer means U is not sufficient, so that additionally in the cylinder inner chamber Z, there are guide elements B1 and B2 or B3 and B4 parallel to the cylinder axis F and which penetrate the piston, as will be described in greater detail in conjunction with FIG. 3. For these and similar embodiments the ratio of the cross-sectional surfaces is not limited. It is also possible to provide more than two guide elements. They are e.g. rod-like with e.g. a round cross-section.

The specific advantage of the embodiment according to FIG. 1*e* in which the cylinder inner chamber has a substantially elliptical cross-section, is that commercially available tubes can be used for producing the cylinder. A choice must be made of a tube, whose smaller internal diameter substantially corresponds to the diameter of the force transfer means and it is sufficient to provide on the larger diameter two facing guide elements B3 and B4.

The areas of the cylinder wall, which represent the guidance points for the force transfer means, are either planar or curved in concave manner against the force transfer means. In all cases the force transfer means has a certain play or clearance relative to the cylinder inner wall and relative to the additional guide elements. The maximum possible buckling of the force transfer means in the case of thrust operation and therefore the force exerted transversely to the movement direction on the guides is dependent on said clearance, the geometrical arrangement of the guidance points and the design of the areas of the cylinder inner wall in which the guide points are located. The smallest buckling would occur in a guide, tightly enclosing on all sides the force transfer means, as would be the case if the piston and the force transfer means have the same cross-sectional surface and both were completely guided by the cylinder wall, but which is not possible due to the condition of varying cross-sectional surfaces. Very similar conditions occur in an embodiment according to FIG. 1*f*, in which the cylinder wall in the vicinity of the guide points A15 and A16 has a substantially identical radius of curvature to the force transfer means. As a function of the design of the force transfer means U, these guide points are guide lines or guide surfaces.

FIGS. 2*a* to 2*c* show exemplified embodiments of the drive according to the invention, which have a circular cylindrical inner chamber Z and piston (not shown) and a non-circular cross-sectional surface of the force transfer means U, where once again the cylinder axis F coincides with the axis of the force transfer means. In the embodiment according to FIG. 2*a*, the cross-sectional surface of the force transfer means U has a triple symmetry axis and three guide points C1 to C4, whilst in the embodiment according to FIG. 2*b* it has a quadruple symmetry axis and four guide points C4 to C7. For both these embodiments and also similar embodiments, in which the cross-sectional surface of the force transfer means substantially corresponds to a regular polygon, no further guide elements are required. An advantage of such embodiments is that the force transfer means U can also be guided outside the drive in a tube or hose having a circular internal cross-section, which is not possible for the embodiment according to FIG. 2*c*. This embodiment has a force transfer means with a substantially elliptical cross-sectional surface and only two guide points C8 and C9 and for a satisfactory guidance must be provided with at least two further guide elements B5 and B6, which penetrate the piston, in the cylinder inner chamber. Another advantage of the embodiments according to FIGS. 2*a* and 2*b* compared with the embodiment according to FIG. 2*c* is that the piston and force transfer means can rotate about the axis F in the cylinder inner chamber, i.e. the guidance points on the cylinder inner wall can change position, which leads to uniform wearing thereof.

Embodiments with a circular cylindrical cylinder are advantageous, because they can be produced from commercially available tubes and because the cylinder heads can be screwed on.

FIG. 3 is a longitudinal section through the embodiment of the inventive drive according to FIG. 1*e* (section III—III). For description purposes reference is again made to the applicant's European patent 57818. The cylinder 1 has a cylinder wall 9 and two cylinder heads 13, 14. The piston 2 is movably positioned in the cylinder, together with the force transfer means U fixed thereto and which extends through one cylinder head 13 into a guide 23. The cylinder 1, the piston 2 and the force transfer means U have a common axis F. The drive can be pneumatically or hydraulically operated, acting as a push and/or pull drive.

As described in conjunction with FIG. 1*e*, in the cylinder inner chamber are provided two further guide elements in the form of guide rods B3 and B4 parallel to the cylinder axis F. They can simultaneously serve as bracing elements, in that they brace the two cylinder heads 13, 14 against the cylinder wall 9. For this purpose each of the guide elements B3, B4 has at its two ends a thread. One end is in each case screwed into the cylinder head 13. The in each case opposite end penetrates the cylinder head 14 and carries nuts, with the aid of which guide elements, cylinder heads and cylinder wall can be fixed.

The guide elements B3, B4 penetrate the piston 2 in the cylinder longitudinal direction. The piston 2 has a substantially elliptical piston ring 15 and round piston rings 16, 17. The said piston rings can be made from all known sealing materials such as Viton, Kel-F, Teflon, Vespel, etc. and serve as seals between the two sides of the cylinder inner chamber on the end face and on the back of the piston 2. The piston ring 15 seals between the piston 2 and the cylinder wall 9, whereas the piston rings 16, 17 seal between the piston 2 and the guide elements B3 and B4.

Each cylinder head 13, 14 is provided with supply channels 18, 19 for a pressure medium, in the present case constituted by compressed air. The supply channels 18, 19 have connections 20, 21 and can be connected by means of control valves to a compressed air source. Thus, the pressure medium for the purpose of double-acting operation can be alternately applied to the supply channels 18 or 19 and can also be vented again. It is also obviously possible to have a single-action operation and corresponding connections for the pressure medium, in that only one side of the piston, particularly that of the force transfer means is supplied with pressure. For resetting purposes it is then e.g. possible to provide a mechanical means (e.g. a spring).

The force transfer means U is fixed with the aid of a connecting member 22 to the piston and within the cylinder 1 is guided by areas of the cylinder inner wall and by the guide elements B3, B4, whilst outside the cylinder it is guided by the guide means 23. The guide means 23, e.g. a flexible tube or hose, can run spatially in a random selectable manner. As a result of the flexibility of the force transfer means U, also in the cylinder inner chamber, the guide means 23 can be led away in a random direction directly from the cylinder head, so that the necessary fitting length of the drive can be limited to a value which is only slightly larger than the cylinder length.

Uses are also conceivable in which on both faces of the piston is fixed a force transfer means, or one end of a single force transfer means. Using such a drive a push or pull force can be transferred in both directions.

I claim:

1. A fluid-operated drive comprising the combination of a cylinder having an inner wall defining a cylinder chamber;

a piston movable in said cylinder chamber;

flexible force transfer means attached to said piston, said piston having a larger cross-section than a cross-section of said force transfer means to permit access of fluid under pressure to both sides of said piston, said force transfer means being at least partly guided by said inner wall of said cylinder; and means for supplying said fluid under pressure to both sides of said piston.

2. A drive according to claim 1 wherein said flexible force transfer means comprises a spherical joint link chain with relatively rotatable and pivotable links.

3. A drive according to claim 2 wherein said cross section of said force transfer means is circular, wherein said cylinder has a central axis located in the center of cross-section of said force transfer means, and wherein said cylinder inner wall is shaped to provide at least two guide points for guiding said force transfer means.

4. A drive according to claim 3 wherein said cross-section of said cylinder inner wall is substantially in the shape of a regular polygon.

5. A drive according to claim 3 wherein said cross-section of said cylinder inner wall is substantially in the shape of an ellipse having a minor diameter substantially equal to the diameter of said cross-section of said force transfer means.

6. A drive according to claim 5 wherein two guidance elements are positioned symmetrically relative to both planes of symmetry of said elliptical cross-section of said cylinder inner wall.

7. A drive according to claim 1 wherein said cross section of said cylinder inner wall is circular, wherein said cylinder has a central axis located in the center of cross-section of said force transfer means, and wherein said force transfer means is shaped to provide at least two guide points for permitting said cylinder wall to guide said force transfer means.

8. A drive according to claim 7 wherein said cylinder further comprises at least two guide elements parallel with said cylinder axis for guiding said force transfer means, said guide elements penetrating said piston means.

9. A drive according to claim 8 wherein said cross-section of said force transfer means is substantially in the shape of an ellipse having a major diameter substantially corresponds to said internal diameter of said cylinder, and wherein said guide elements lie on opposite sides of said force transfer means along the smaller diameter of said ellipse.

10. A drive according to claim 9 wherein said cross-section of said force transfer means is substantially in the shape of a regular polygon.

* * * * *